United States Patent [19]

Van Doren et al.

[11] 4,231,404

[45] Nov. 4, 1980

[54] DEVICE FOR TRIMMING THE REEDS OF WIND INSTRUMENTS

[75] Inventors: Bernard M. Van Doren, Saint Germain En Laye; Jacques G. Frank, Conflana-Sainte Honorine, both of France

[73] Assignee: Etablissements VanDoren, Paris, France

[21] Appl. No.: 43,509

[22] Filed: May 29, 1979

[30] Foreign Application Priority Data

Dec. 22, 1978 [FR] France ..... 73.36140

[51] Int. Cl.[3] ..... G10G 7/00

[52] U.S. Cl. ..... 144/2 R; 84/458

[58] Field of Search ..... 84/383 A, 453, 458; 144/2 R, 323

[56] References Cited

U.S. PATENT DOCUMENTS

| | | | |
|---|---|---|---|
| 555,962 | 3/1896 | Meister | 84/458 X |
| 1,680,159 | 8/1928 | McVicker | 84/383 A |
| 4,172,482 | 10/1979 | Gomez | 144/323 X |

FOREIGN PATENT DOCUMENTS

| | | | |
|---|---|---|---|
| 1027282 | 5/1953 | France | 84/453 |

*Primary Examiner*—Lawrence R. Franklin

*Attorney, Agent, or Firm*—Scully, Scott, Murphy & Presser

[57] ABSTRACT

The invention relates to a device for trimming the reed of a wind instrument.

This device comprises a body a flat part of which forms a support for said reed, a removable cutting member having a profile corresponding to that of the end of said reed and projecting perpendicularly to the surface of said flat part, and a compression member pivotably mounted about a pin on said body and disposed so that it may be applied manually against said cutting member.

Said body comprises two parts whose positions are adjustable in relation to each other, the part forming a support for the reed comprising an end whose shape corresponds to the end of the reed, whereas the other part comprises a recess having a complementary shape, the cutting member being formed by a thin deformable blade, nipped between said parts.

6 Claims, 3 Drawing Figures

DEVICE FOR TRIMMING THE REEDS OF WIND INSTRUMENTS

The invention relates to a device for cutting the reeds of wind instruments.

It is known in fact that musicians often consider that the reed of their instrument is too "weak", i.e. too flexible or too pliant, and that they are therefore led to retrim their reeds.

For this purpose, devices have already been proposed in which the body of the reed is held on a support by a clamping collar, whereas the edge of the end to be cut bears on the cutting edge of a portion cut out in the support. A push-rod, whose end has a profile complementary to that of the cut-out portion, bears on the body of the reed and may be actuated by the thumb or another finger, so as to exert a shearing stress on the reed, whose end is thus trimmed to the profile of the cut-out portion.

This type of device has however several disadvantages:

- on the one hand, the shearing stress exerted on the reed risks damaging this latter;
- on the other hand, the user cannot adjust accurately the portion of the reed to be trimmed;
- finally, the cutting system properly speaking is formed by the cutting edge of the cut-out portion and so cannot be resharpened.

The invention aims at remedying these disadvantages by proposing a reed cutter in which the cutting stress is exerted only on the part of the reed to be trimmed, which leads itself to an accurate positioning of the reed in relation to the cutting system and whose cutting member may be easily replaced or resharpened.

For this purpose, the invention provides a device for trimming the reed of a musical instrument, characterized in that it comprises a body a flat part of which forms a support for said reed, a removable cutting member having a profile corresponding to that of the end of said reed and projecting perpendicularly to the surface of said flat part, and a compression member pivotably mounted about a pin on said body and disposed so that it may be applied manually against said cutting member.

In a particularly advantageous embodiment of the invention, said body will comprise two parts whose positions are adjustable in relation to each other, the part forming the support for the reed comprising an end whose shape corresponds to the end of the reed, whereas the other part comprises a recess having a complementary shape, the cutting member being formed by a thin deformable blade, which it is sufficient to nip by deforming it between said two parts to give it the profile of the end of the reed.

These two parts will advantageously be able to be housed in a case, in which a screw adjusting system will allow them to be moved in relation to each other.

The compression member will be able to be formed simply by a flat part pivotably mounted at the end of this case disposed in front of the end of the reed. Preferably, this flat part will bear against the reed through a removable rubber plate, which it is thus possible to replace.

The accompanying drawings, given by way of a non limiting example, illustrate such an embodiment of the invention. In these drawings.

Figure 1:
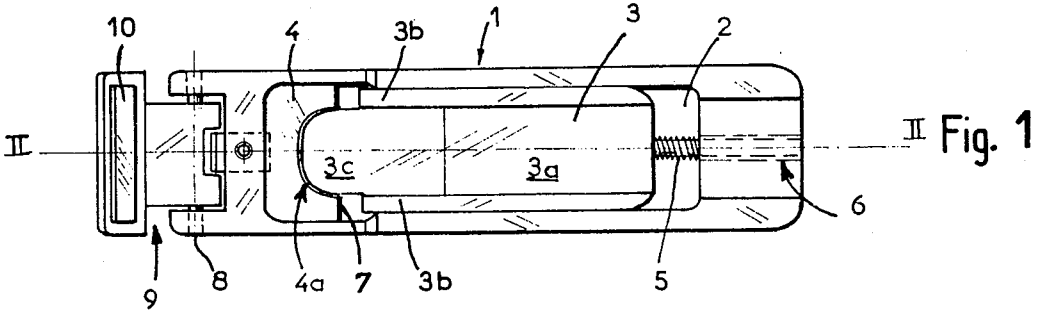
FIG. 1 is a top view of the device, with the member for compressing the end of the reed lifted up.
Figure 2:
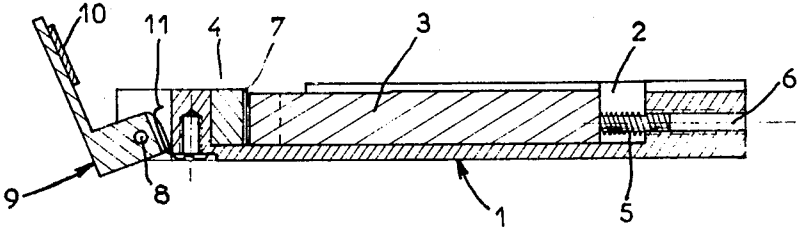
FIG. 2 is a longitudinal section along line II-II of FIG. 1.

As can be seen in FIGS. 1 and 2, this device comprises a rectangular case 1, in a recess 2 of which are housed two parts 3 and 4 whose positions are adjustable in relation to each other.

Part 3 is intended to serve as a support for the flat part of the reed and for this purpose it has a flat surface 3*a* and two lateral wings 3*b*, between which the reed is placed. The front end 3*c* of this part 3 has a shape similar to that of the front end of the reed to be trimmed. Part 4 has, opposite end 3*c*, a recessed portion 4*a* having a complementary shape. End 3*c* is urged towards the recessed portion 4*a* of part 4 by a screw 5, which bears against the opposite end of part 3 and which is housed in a tapping 6 at the corresponding end of case 1.

Between end 3*c* of part 3 and recess 4*a* is nipped a thin flexible plate 7, initially flat in shape, but which has been deformed by part 3, urged by screw 5, so that it takes on the shape of the end 3*c* of this part 3, i.e. the shape of the end of the reed to be trimmed. The edge of this blade projects slightly above the end 3*c* of part 3, so as to be able to support the end of the reed to be trimmed.

At the front end of case 1 there is pivotably mounted about a transverse pin 8 a mobile member 9, a flat part 10 of which may come to rest, by pivoting, against a spring blade 11, on the cutting edge of blade 7.

The flat part 10 is preferably made from a pliable material such as rubber, so as to exert an equal and measured effect over the whole of the part of the reed with which it is in contact. Advantageously, this flat part will be removable, so as to be able to be replaced when worn, and will be for example formed by a self-adhesive rubber film.

Figure 3:
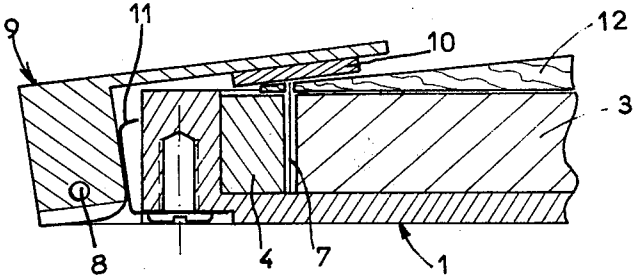
FIG. 3 is a partial section, on a larger scale, illustrating the operation of the device.

To trim the end of a reed 12, all that is then required, as shown in FIG. 3, is to place the flat part of this reed on part 3, the end of said reed bearing on blade 7, and to cause part 9 to pivot about pin 8 so as to exert a cutting action with part 10.

It will be noted that it is possible to accurately adjust the position of reed 12 in relation to blade 7, which allows the instrumentalist to trim his reeds with all the care required. It will also be noted that the cutting effect of the pivoting part 9 may be obtained without effort, by means of a single finger of the hand.

To change blade 7, when it is not sufficiently sharp, all that is required is to separate parts 3 and 4 from one another to free the worn blade.

The reed cutter according to the invention is then of a simple and practical design and allows the user to trim his reeds accurately and without effort.

What is claimed is:

1. A device for retrimming the reed of a wind instrument, characterized in that it comprises a body a flat part of which forms a support for said reed, a removable cutting member having a profile corresponding to that of the end of said reed and projecting perpendicularly to the surface of said flat part, and a compression member pivotably mounted about a pin on said body and disposed so that it may be applied manually against said cutting member.

2. A device according to claim 1, characterized in that said body comprises two parts whose positions are adjustable with respect to each other, the part forming the support for the reed comprising an end whose shape corresponds to the end of the reed, whereas the other part comprises a recess having a complementary shape, the cutting member being formed by a thin deformable blade, nipped between said parts.

3. A device according to claim 2, characterized in that said parts are housed in a case at the front end of which said compression member is pivotably mounted.

4. A device according to claim 3, characterized in that said case comprises an adjusting screw bearing against one of said parts, for applying it against the other part while nipping said blade.

5. A device according to one of claims 1 to 4, characterized in that the part of the compression member intended to come into contact with the reed is covered with a pliable material such as rubber.

6. A device according to claim 5, characterized in that said pliable material may be removed from the compression member.

* * * * *